US008749291B2

(12) United States Patent
Kawagoe et al.

(10) Patent No.: US 8,749,291 B2
(45) Date of Patent: Jun. 10, 2014

(54) LCD DRIVING CIRCUIT WITH ESD PROTECTION

(75) Inventors: Masakuni Kawagoe, Miyazaki (JP); Shoji Nitawaki, Miyazaki (JP); Chikashi Fuchigami, Miyazaki (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 1121 days.

(21) Appl. No.: 12/724,716

(22) Filed: Mar. 16, 2010

(65) Prior Publication Data

US 2010/0245342 A1 Sep. 30, 2010

(30) Foreign Application Priority Data

Mar. 30, 2009 (JP) ..... 2009-081317

(51) Int. Cl.
*H03K 5/08* (2006.01)

(52) U.S. Cl.
USPC ..... 327/318; 327/310

(58) Field of Classification Search
USPC ..... 327/310–312, 318–322
See application file for complete search history.

(56) References Cited

U.S. PATENT DOCUMENTS 4,066,918 A * 1/1978 Heuner et al. ..... 327/318
4,440,980 A * 4/1984 Bakker ..... 379/395
4,990,802 A * 2/1991 Smooha ..... 326/15
5,264,723 A * 11/1993 Strauss ..... 257/532
5,650,652 A * 7/1997 Mizutani et al. ..... 257/355
8,395,914 B2 * 3/2013 Klootwijk et al. ..... 363/60
2011/0160803 A1 * 6/2011 Stessman et al. ..... 607/62
2011/0160807 A1 * 6/2011 Lyden et al. ..... 607/63
2013/0027114 A1 * 1/2013 Petruzzi et al. ..... 327/437
2013/0089199 A1 * 4/2013 Amine et al. ..... 379/413

FOREIGN PATENT DOCUMENTS

JP 60-037156 2/1985
JP 04-247654 9/1992
JP 05-160341 6/1993
JP 2003-257971 9/2003
JP 2007-043032 2/2007

OTHER PUBLICATIONS

Japanese Office Action dated Sep. 17, 2013.
Japanese Office Action dated Jan. 14, 2014.

* cited by examiner

*Primary Examiner* — William Hernandez
(74) *Attorney, Agent, or Firm* — Volentine & Whitt, PLLC

(57) ABSTRACT

A semiconductor integrated circuit has an output terminal connected to an external load, an internal signal line by which the output terminal is connected to an internal node, and a voltage generator that outputs a voltage to the internal node, for output through the internal signal line and the output terminal to the external load. A voltage attenuating element is connected to the internal signal line to attenuate voltage swings on the internal signal line. A limiting circuit is connected to the internal node to limit the voltage at the internal node to a predetermined range. Moderate voltage swings caused by external electromagnetic interference are kept within the predetermined range by the voltage attenuating element, so that the limiting circuit does not operate and the average output voltage is not changed.

15 Claims, 14 Drawing Sheets

LCD DRIVING CIRCUIT WITH ESD PROTECTION

BACKGROUND OF THE INVENTION

1. Field of the Invention

The present invention relates to a semiconductor integrated circuit that drives an external load, more particularly to a semiconductor integrated circuit with improved electromagnetic compatibility.

2. Description of the Related Art

Electromagnetic compatibility (EMC) is an important issue for integrated circuits in general and is becoming a critical issue for the integrated circuits used in display devices such as liquid crystal displays (LCDs). The signal lines connecting the driving circuits of an LCD to the liquid crystal cells in its liquid crystal panel readily pick up electromagnetic interference (EMI) generated by nearby electrical and electronic devices. As the level of integration of the driver circuits increases and the number of output signal lines per driver increases, reducing susceptibility to such interference becomes essential. There are especially stringent EMC testing requirements for the LCDs used in mobile telephones, in which the effect of wireless signals transmitted by the telephone must be considered.

Among the many other uses to which LCDs are put, LCDs with comparatively large liquid crystal panels are now used in automobiles. The electrically noisy automobile environment places further EMC requirements on LCD driver circuits.

FIG. 1 shows a liquid crystal panel 50 and part of a conventional LCD driver 59. The liquid crystal panel 50 is, for example, a super-twisted nematic panel with a matrix of wiring including segment (SEG) signal lines 51 and common (COM) signal lines 52 that cross at liquid crystal cells 53. Only one segment signal line 51, common signal line 52, and liquid crystal cell 53 are shown. The segment signal line 51 and common signal line 52 are connected to the driver 59 by respective interconnecting lines 54, 55. Application of certain voltages to the segment signal line 51 and common signal line 52 controls the liquid crystal cell 53 to display a pixel in an image.

The driver 59 includes a segment driver 60 and a common driver 70 with respective output stages 63, 73 and electrostatic discharge (ESD) protection circuits 64, 74. The output stages 63, 73 select voltages generated by a voltage dividing circuit 62 and output the selected voltages to respective output terminals 66, 76, to which the interconnecting lines 54, 55 are connected.

The voltage dividing circuit 62 includes a p-channel metal-oxide-semiconductor (PMOS) transistor 62*a*, three resistors 62*b*, 62*c*, 62*d*, and an n-channel metal-oxide-semiconductor (NMOS) transistor 62*e* connected in series between a power supply terminal to which a positive supply voltage VDD is applied and ground terminal to which a ground voltage VSS is applied. When the transistors 62*a*, 62*e* are turned on, the resistors 62*b*, 62*c*, 62*d* function as a voltage divider and the voltage dividing circuit 62 outputs four voltages V1, V2, V3, V4, of which V1 is equal to VSS and V4 is equal to VDD.

The output stage 63 of the segment driver 60 includes a pair of analog switches 63*a*, 63*b*, each having a PMOS transistor and an NMOS transistor connected in parallel. When switched on by control signals (not shown), these analog switches 63*a*, 63*b* pass voltages V3 and V2, respectively, to the segment output terminal 66. The output stage 63 also includes a PMOS transistor 63*c* and an NMOS transistor 63*d* that can be switched on pass voltages V4 and V1, respectively, to the segment output terminal 66.

The ESD protection circuit 64 includes a pair of diodes 64*a*, 64*b* connected to the internal signal line leading from the output stage 63 to the segment output terminal 66 to limit the voltage on this internal signal line to the range between VDD and VSS.

The output stage 73 and ESD protection circuit 74 of the common driver 70 have a similar configuration, including analog switches 73*a*, 73*b*, a PMOS transistor 73*c*, an NMOS transistor 73*d*, and a pair of diodes 74*a*, 74*b*.

When, for example, the segment driver 60 is controlled to output voltage V3 from output terminal 66 and the common driver 70 is controlled to output voltage V2 from output terminal 76, a voltage equal to the difference (V3−V2) is applied across liquid crystal cell 53, causing a pixel to be displayed at a corresponding intensity level.

Besides functioning as signal lines for the voltages output by the driver 59, the segment signal line 51 and interconnecting line 54 form a single continuous antenna-like conductor that can easily pick up stray electromagnetic interference, indicated by the arrow marked EMI in FIG. 1. Similarly, the common signal line 52 and interconnecting line 55 form another antenna-like conductor that can pick up electromagnetic interference. Such interference effects can take the voltages on the interconnecting lines 54, 55 outside the range between VSS and VDD. The ESD protection circuits 64, 74 protect the driver 59 from damage that could be caused by voltages higher than VDD or lower than VSS.

As a further countermeasure to EMI, in Japanese Patent Application Publication No. 2003-257971 Matsumoto discloses a semiconductor device with dummy wiring interspersed among its internal signal lines. The dummy wiring is held at a fixed reference potential and provides a shielding effect.

A problem with the conventional LCD in FIG. 1 is that when electromagnetic interference is present, the ESD protection circuits 64, 74 can alter the voltages output by the driver 59 and thereby alter the intensity levels of displayed pixels.

Suppose, for example, that while segment driver 60 is driving output terminal 66 at voltage V3, the segment signal line 51 and interconnecting line 54 pick up electromagnetic noise, causing the voltage on segment signal line 51 and interconnecting line 54 to oscillate with the interference waveform IW1 in FIG. 2. Although the oscillations take this waveform above V4 (VDD), the average voltage on segment signal line 51 and interconnecting line 54 is still V3. The VDD clamping effect of ESD protection circuit 64, however, trims the excursions above V4 to produce the modified interference waveform IWX, thereby decreasing the average voltage output from terminal 66 by an amount ΔV3.

If common driver 70 is simultaneously driving output terminal 76 at voltage V2, the same interference waveform, superimposed on the voltage V2 on common signal line 52 and interconnecting line 55, stays below V4 but also goes below V1 (VSS), as shown in FIG. 3. The VSS clamping effect of ESD protection circuit 74 raises the average voltage output from output terminal 76 by an amount ΔV2.

The average voltage applied across liquid crystal cell 53 is accordingly not the intended voltage (V3−V2) but a voltage reduced from this value by the sum of ΔV2 and ΔV3, resulting in a pixel with an unintended intensity level. Electromagnetic interference thus visibly disturbs the displayed image.

Since the dummy wiring proposed by Matsumoto fails to shield the segment signal line 51, common signal line 52, and interconnecting lines 54, 55, it fails to reduce this visible image disturbance.

SUMMARY OF THE INVENTION

A general object of the present invention is to provide a semiconductor integrated circuit with improved electromagnetic compatibility.

A more specific object is to provide an LCD driver with improved electromagnetic compatibility.

Another more specific object is to reduce susceptibility to external electromagnetic interference conducted into a semiconductor integrated circuit through its output terminals without changing the average voltages output from the output terminals.

The invention provides a semiconductor integrated circuit having a substrate on which semiconductor circuit elements are formed, and an output terminal connected to an external load. The semiconductor integrated circuit also has an internal signal line by which the output terminal is connected to an internal node. A voltage generator in the semiconductor integrated circuit generates a voltage that is supplied to the internal node, from which the voltage is output through the internal signal line and the output terminal to the external load.

The semiconductor integrated circuit includes a voltage attenuating element connected to the internal signal line to attenuate voltage swings on the internal signal line.

The semiconductor integrated circuit also includes a voltage limiting circuit connected to the internal node to limit the voltage at the internal node to a predetermined range. The voltage limiting circuit operates when, after attenuation of the voltage swings by the voltage limiting circuit, the voltage at the internal node still exceeds the predetermined range.

The voltage swings may be caused by electromagnetic interference external to the semiconductor integrated circuit. The effect of the voltage attenuating element is to attenuate most such voltage swings so that they stay within the predetermined range and the voltage limiting circuit does not operate. For such swings, the voltage attenuating element provides protection against electrostatic damage without altering the average voltage on the internal signal line, so the average output voltage is not altered. For larger voltage swings, the voltage limiting circuit provides protection.

DETAILED DESCRIPTION OF THE INVENTION

Figure 1:
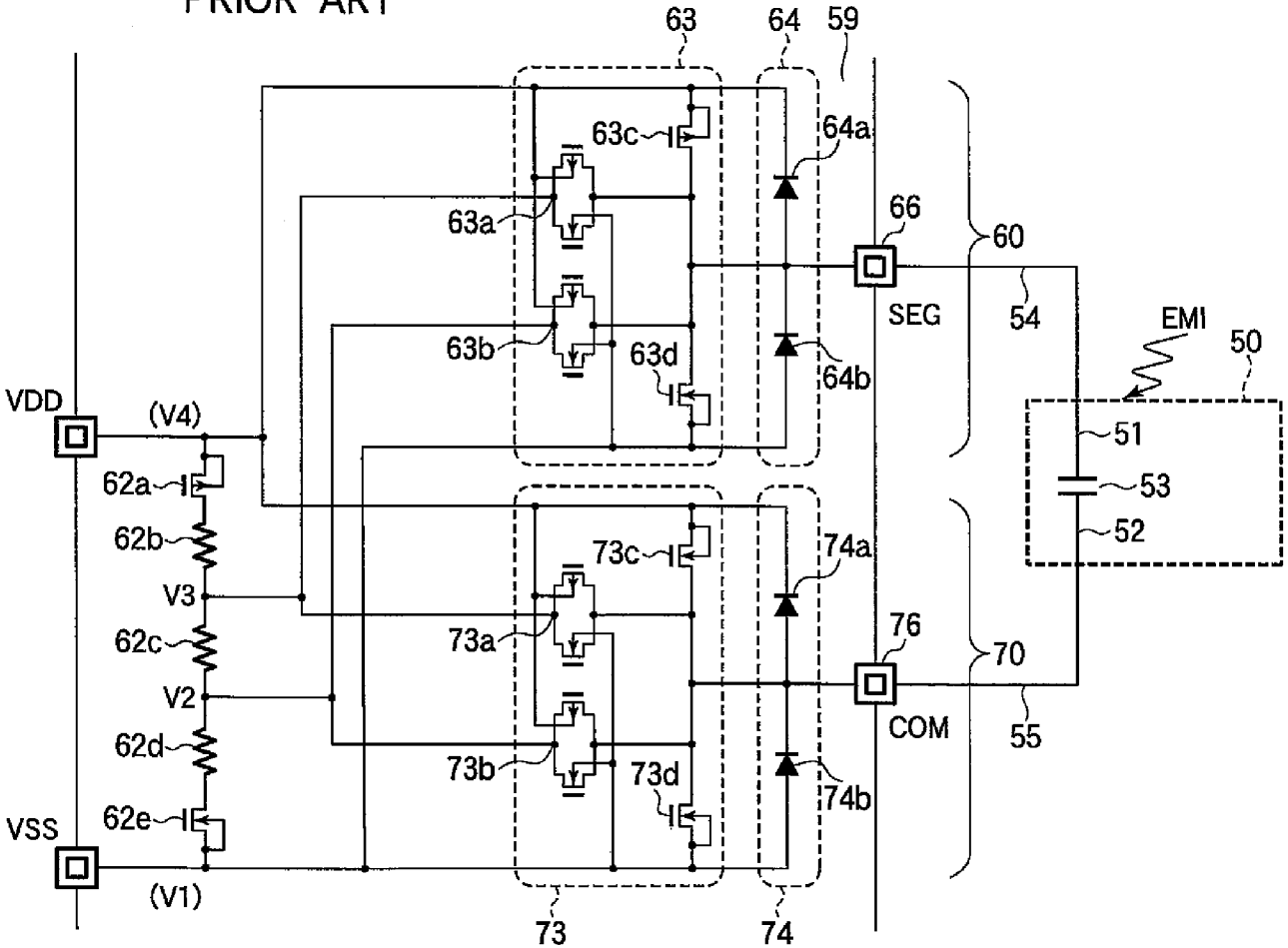
FIG.1 PRIOR ART
FIG. 1 is a schematic circuit diagram illustrating parts of a conventional LCD.
Figure 2:
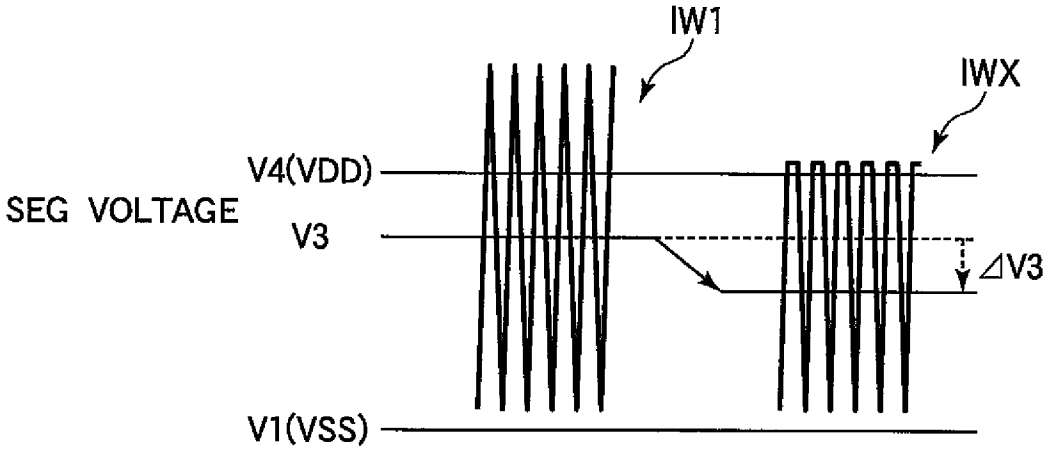
FIG.2 PRIOR ART
FIGS. 2 and 3 are waveform diagrams illustrating the effect of electromagnetic interference in the conventional LCD.
Figure 3:
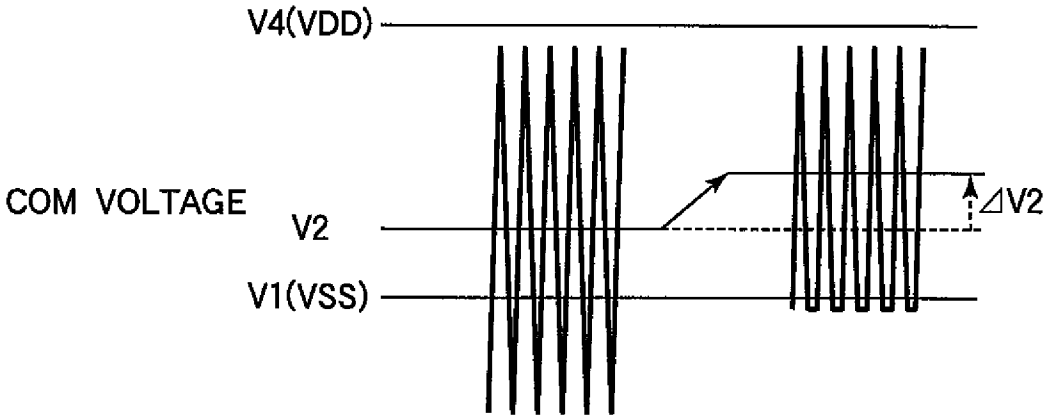
FIG.3 PRIOR ART

Embodiments of the invention will now be described with reference to the attached non-limiting drawings, in which like elements are indicated by like reference characters.

The term 'active region' will be used to denote a heavily doped surface region in a semiconductor substrate. Active regions are capable of functioning as electrode regions for circuit elements formed in the substrate.

Figure 4:
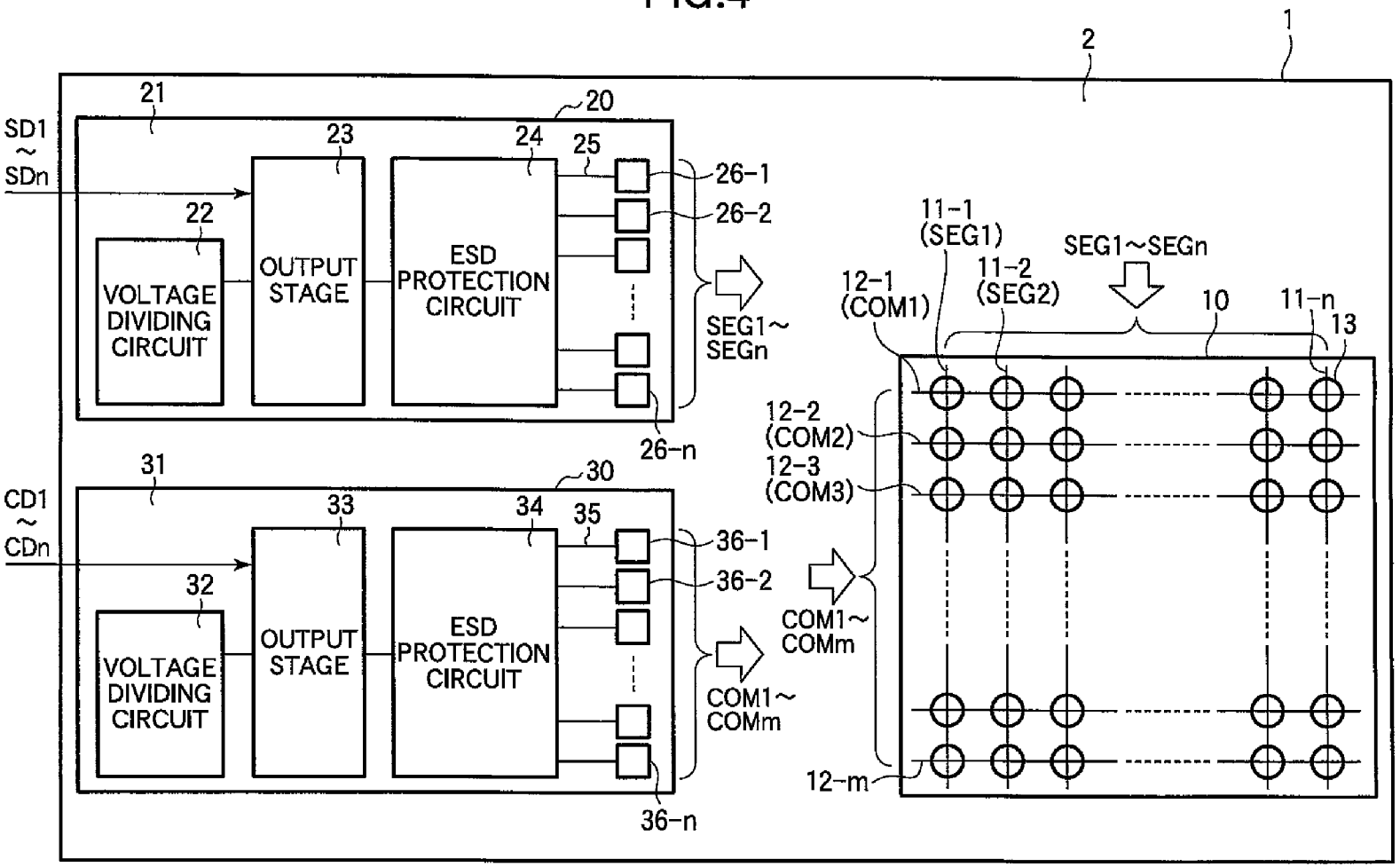
FIG. 4 is a schematic plan view of an LCD to which the present invention may be applied.

The embodiments are LCDs with the general structure shown in FIG. 4, including a substrate 2 on which are mounted a liquid crystal panel 10, a segment driver 20, and a common driver 30.

The liquid crystal panel 10 has a plurality of mutually parallel segment signal lines 11-1 to **11-*n* extending, for example, in the column direction of the liquid crystal panel 10, a plurality of mutually parallel common signal lines 12-1 to 12-*m* extending, for example, in the row direction of the liquid crystal panel 10, and liquid crystal cells 13. The segment signal lines 11 and the common signal lines 12 cross orthogonally at the liquid crystal cells 13**.

The segment driver 20 is formed on a p-type semiconductor substrate 21 and includes a voltage dividing circuit 22 and an output stage 23 that function as a voltage generator, an ESD protection circuit 24 that functions as a voltage limiting circuit, internal signal lines 25, and segment output terminals 26-1 to **26-*n*. The output stage 23 selects voltages generated by the voltage dividing circuit 22 according to display data signals SD1 to SDn received from an external circuit (not shown) and outputs the selected voltages as segment signals SEG1 to SEGn through the ESD protection circuit 24 to the segment output terminals 26-1 to 26-*n* on the internal signal lines 25. The segment output terminals 26-1 to 26-*n* are connected to the segment signal lines 11-1 to 11-*n* in the liquid crystal panel 10**.

The common driver 30 has a similar configuration including a p-type semiconductor substrate 31, a voltage dividing circuit 32, an output stage 33, an ESD protection circuit 34, internal signal lines 35, and common output terminals 36-1 to **36-*m*. The common driver 30 selects voltages generated by its voltage dividing circuit 32 according to scanning data CD1 to CDm received from the external circuit and outputs the selected voltages as common signals COM1 to COMm to the common signal lines 12 of the liquid crystal panel 10**.

First Embodiment

Figure 5:
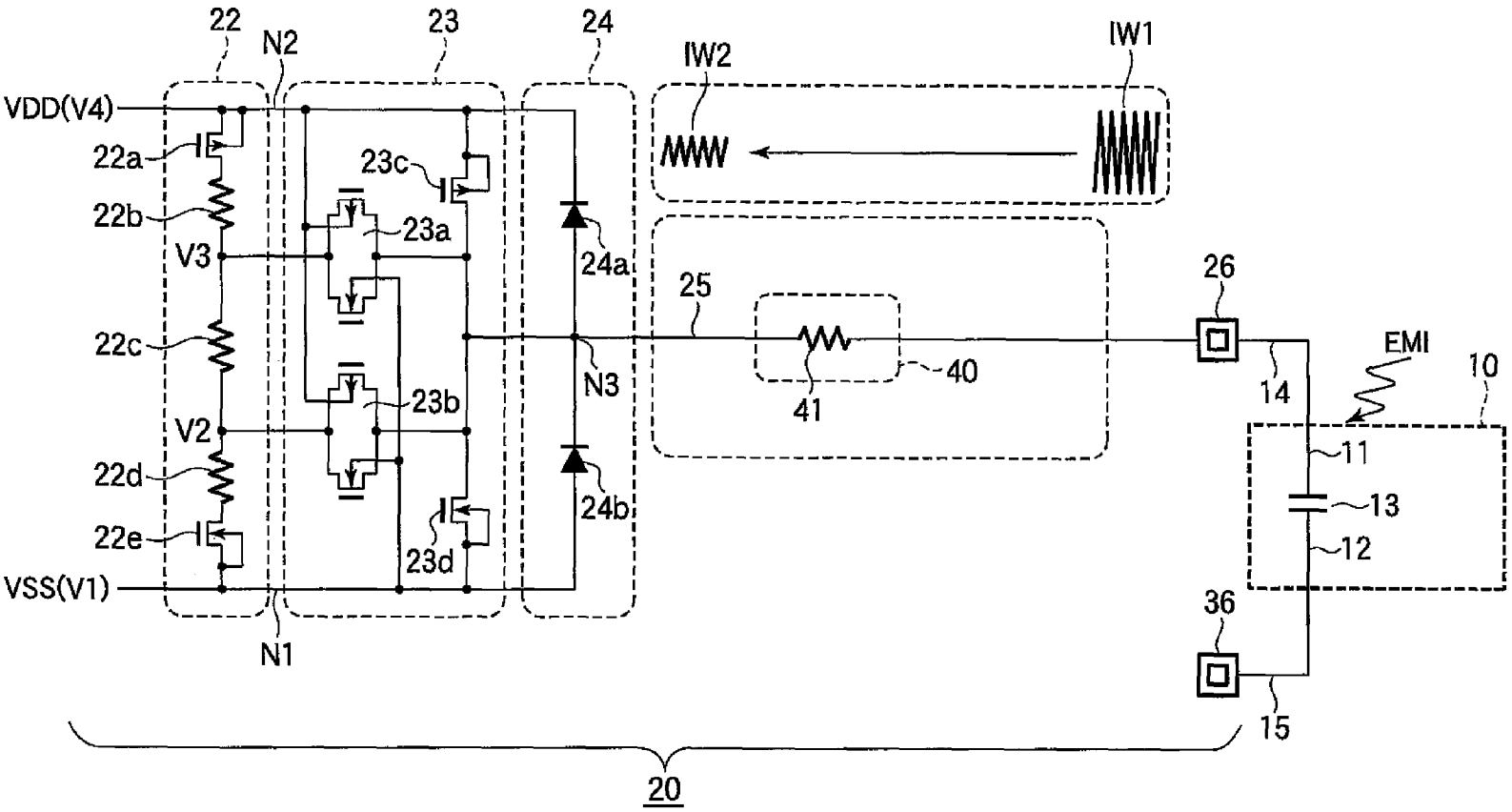
FIG. 5 is a schematic circuit diagram illustrating parts of the LCD in FIG. 4 according to a first embodiment of the invention.

Referring to FIG. 5, the segment driver 20 in the first embodiment has a voltage dividing circuit 22 and output stage 23 similar to the conventional circuits shown in FIG. 1. The voltage dividing circuit 22 includes a PMOS transistor **22*a*, three resistors 22*b*, 22*c*, 22*d*, and an NMOS transistor 22*e* connected in series between a first power supply node N1 and a second power supply node N2. The first power supply node N1 is connected to the source electrode of the NMOS transistor 22*e* and to a ground terminal for input of a ground voltage VSS from an external power supply (not shown). The second power supply node N2 is connected to the source electrode of the PMOS transistor 22*a*** and to a power supply terminal for input of a supply voltage VDD from the external power supply. Voltages V1 (VSS), V2, V3, and V4 (VDD) are output from the first power supply node N1, a node between resistors 22*d* and 22*c*, a node between resistors 22*c* and 22*b*, and the second power supply node N2, respectively, to analog switches 23*a*, 23*b*, a PMOS transistor 23*c*, and an NMOS transistor 23*d* in the output stage 23.

Analog switch 23*a* in the output stage 23, when turned on by a display data signal (not shown), passes voltage V3 to an internal node N3 in the ESD protection circuit 24. Analog switch 23*b*, when turned on by another display data signal (not shown), passes voltage V2 to internal node N3. PMOS transistor 23*c*, when turned on by yet another display data signal (not shown), passes voltage V4 to internal node N3. NMOS transistor 23*d*, when turned on by still another display data signal (not shown), passes voltage V1 to internal node N3.

The ESD protection circuit 24 has diodes 24*a*, 24*b* that protect the output stage 23 by limiting the voltage at internal node N3 to the range between the ground voltage VSS and the power supply voltage VDD. Diode 24*a* has its cathode connected to the second power supply node N2 and its anode connected to internal node N3. Diode 24*b* has its cathode connected to internal node N3 and its anode connected to the first power supply node N1.

An internal signal line 25 interconnects internal node N3 in the ESD protection circuit 24 to a segment output terminal 26 (one of the terminals 26-*i* to 26-*n* shown in FIG. 4) through an n-well resistor 41 that will be described later. The segment output terminal 26 is connected through an interconnecting line 14 to a segment signal line 11 (one of the segment signal lines 11-1 to 11-*n* shown in FIG. 4). A common output terminal 36 (one of the output terminals 36-1 to 36-*n* of the common driver 30 shown in FIG. 4) is connected through an interconnecting line 15 to a common signal line 12 (one of the common signal lines 12-1 to 12-*n* shown in FIG. 4). A liquid crystal cell 13 is positioned where the segment signal line 11 and the common signal line 12 intersect.

Nodes N1, N2, N3 are wiring patterns: node N1 extends from the source of NMOS transistor 22*e* to the anode of diode 24*b*; node N2 extends from the source of PMOS transistor 22*a* to the cathode of diode 24*a*; node N3 extends from the anode of diode 24*a* to the cathode of diode 24*b*.

The common driver 30 is similar in structure to the segment driver 20, so drawings and a description will be omitted.

Figure 6:
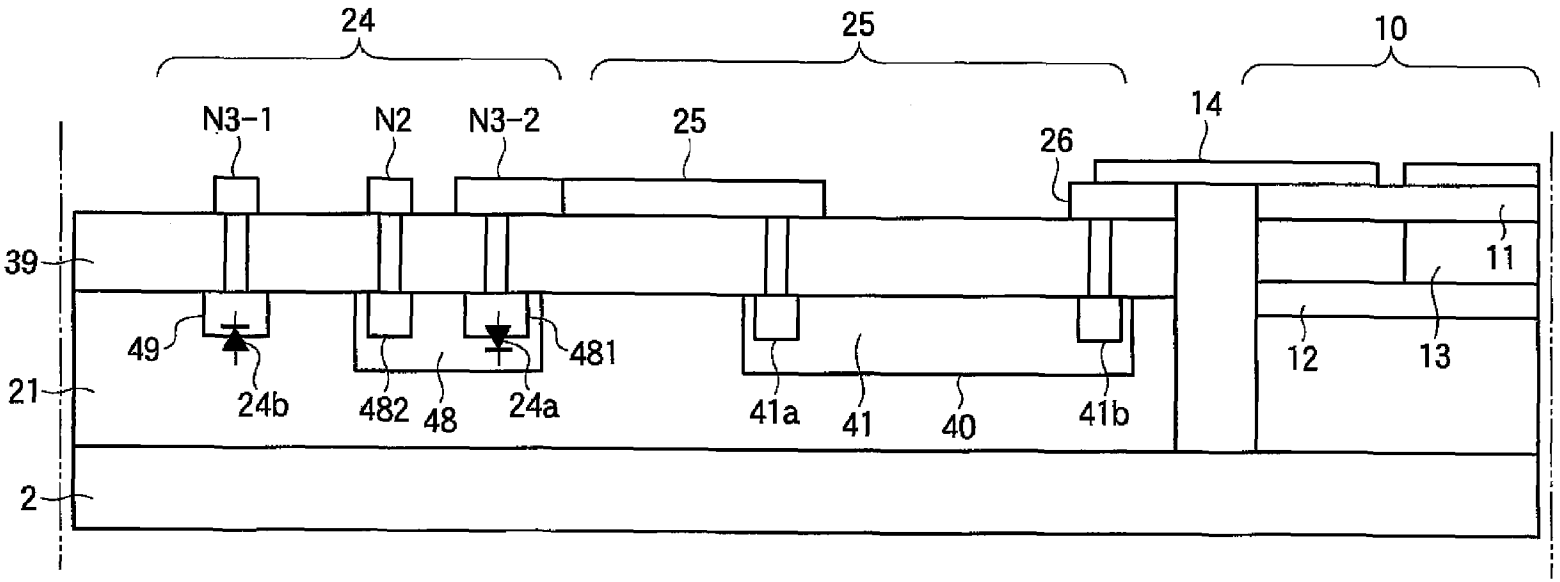
FIG. 6 is a sectional view of part of the circuit in FIG. 5.

A sectional view of the ESD protection circuit 24 and internal signal line 25 in FIG. 5 and the relevant part of the liquid crystal panel 10 is shown in FIG. 6. The second power supply node N2, internal node N3, internal signal line 25, and segment output terminal 26 are formed on a dielectric layer 39 that covers the p-type segment driver substrate 21. Nodes N3-1 and N3-2 are both part of the wiring pattern that forms internal node N3. The p-type substrate 21 is electrically connected to the first power supply node N1, which is not shown in FIG. 6.

In the liquid crystal panel 10, the segment signal line 11 is disposed above and the common signal line 12 is disposed below the liquid crystal cell 13. If, for example, the segment signal line 11 is driven at voltage V3 and the common signal line 12 is driven at voltage V2, a voltage equal to the difference (V3−V2) is applied across the liquid crystal cell 13, causing a pixel to be displayed at a corresponding intensity level. The segment signal line 11 is connected through interconnecting line 14 to segment output terminal 26 on the semiconductor substrate 21 of the segment driver. The common signal line 12 is connected in a similar way (not shown) to the common driver 30.

A pair of n-type wells, referred to as n-wells 40, 48, are formed in the p-type semiconductor substrate 21 of the segment driver. Diode 24*a* in the ESD protection circuit 24 is formed by the pn junction between n-well 48 and a p-type active region 481 formed in n-well 48. The p-type active region 481 is connected to the internal node N3-2 through a contact hole formed in the dielectric layer 39. An n-type active region 482 is also formed in n-well 48 and is connected to the second power supply node N2 through a contact hole formed in the dielectric layer 39. Diode 24*b* is formed by the pn junction between the p-type semiconductor substrate 21 and an n-type active region 49 formed in the semiconductor substrate 21. This n-type active region 49 is connected to internal node N3-1 through a contact hole formed in the dielectric layer 39. Both parts N3-1, N3-2 of internal node N3 are electrically connected to the internal signal line 25.

One end of n-well 40 is electrically connected to part of the wiring pattern of the internal signal line 25 via an n-type active region 41*a* formed in n-well 40 and a contact hole formed in the dielectric layer 39. The other end of n-well 40 is electrically connected to the segment output terminal 26 via an n-type active region 41*b* formed in n-well 40 and another contact hole formed in the dielectric layer 39. N-well 40 has a higher electrical resistance than the internal signal line 25 and functions as a resistor 41.

The operation of the LCD 1 will now be described. First the basic display operation will be described.

In the liquid crystal panel 10 shown in FIG. 4, voltages are applied to the common signal lines 12-1 to 12-*m* according to scan data CD1 to CDM, and voltages are applied to the segment signal lines 11-1 to 11-*m* according to display data SD1 to SDn. The intensity of the pixel displayed by the liquid crystal cell 13 shown in FIGS. 5 and 6 is controlled by the difference between the voltages applied to the segment signal line 11 and the common signal line 12 that intersect at this liquid crystal cell 13.

Figure 7A:
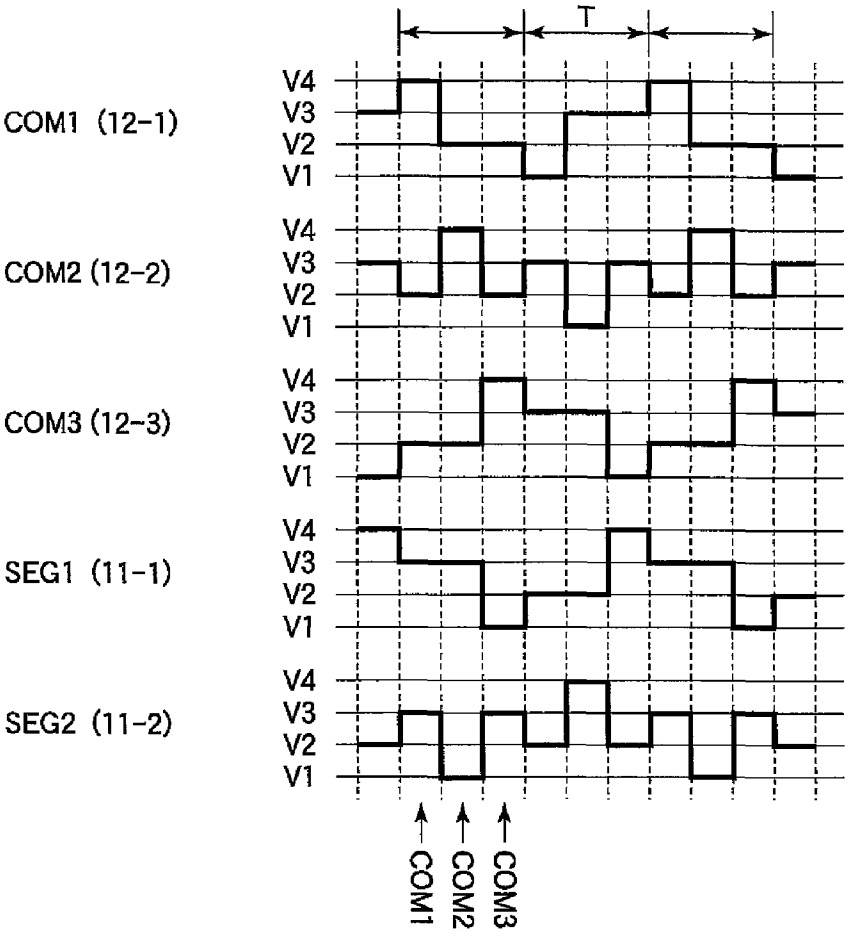
FIG. 7A illustrates waveforms on some of the common and segment signal lines in FIG. 4.

For simplicity, a case in which the liquid crystal panel 10 has only two segment lines (n=2) and three common lines (m=3) will be described. FIG. 7A shows waveforms of the three common signals COM1 to COM3 and two segment signals SEG1, SEG2 used in this LCD 1. The horizontal axis in FIG. 7A indicates time. The common signal lines 12-1 to 12-3 are scanned, in a cyclic sequence in which a common signal line is selected when the corresponding common signal COM1, COM2, or COM3 is at either the power supply or ground voltage (V4 or V1), and is in effect not selected when the corresponding common signal is at an intermediate voltage (V2 or V3). The voltage levels of SEG1 and SEG2 determine whether the liquid crystal cells 13 on the selected common signal line are light or dark.

In the first cycle, for example, initially COM1 is set to voltage V4 and both SEG1 and SEG2 are set to voltage V3, so a small voltage difference (V4−V3) is applied across the liquid crystal cells 13 at the intersections of common signal line 12-1 with segment signal lines 11-1 and 11-2, causing these liquid crystal cells 13 to appear dark.

Next, COM2 is set to voltage V4. SEG1 remains at voltage V3 but SEG2 is set to voltage V1. A small voltage difference (V4−V3) is applied across the liquid crystal cell 13 at the intersection of common signal line 12-2 and segment signal line 11-1, causing this liquid crystal cell 13 to appear dark, but a large voltage difference (V4−V1) is applied across the liquid crystal cell 13 at the intersection of common signal line 12-2 and segment signal line 11-2, causing this liquid crystal cell 13 to appear light.

Figure 7B:
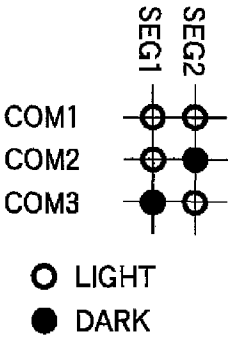
FIG. 7B illustrates a display produced by the waveforms in FIG. 7A.

Control of the pixels on the liquid crystal panel 10 continues in this way, with a polarity inversion in each successive scanning cycle. FIG. 7B illustrates the resulting display.

The liquid crystal panel 10 functions as a capacitive load on the segment and common drivers 20, 30, but the scanning cycle length T is long enough that the n-well resistor 41 on each internal signal line does not significantly alter the output segment voltage or common voltage; its only effect is on the transition times of the segment and common signals.

Next the operation of the segment driver 20 in the presence of electromagnetic interference will be described with reference again to FIGS. 5 and 6.

The ESD protection circuit 24 limits the voltage at the internal node N3 by connecting node N3 to the power supply voltage VDD through diode 24*a* and to the power supply voltage VSS through diode 24*b*. As long as the voltage at node N3 is between VDD and VSS, both diodes 24*a*, 24*b* are reverse biased and the voltage at node N3 remains unaltered. If the voltage at node N3 exceeds VDD by an amount greater than the threshold voltage of diode 24*a*, diode 24*a* turns on and conducts current from node N3 to the second power supply node N2, returning the voltage at node N3 substantially to VDD. If the voltage at node N3 goes below VSS by an amount greater than the threshold voltage of diode 24*b*, diode 24*b* conducts current from the first power supply node N1 through the p-type semiconductor substrate 21 to node N3, returning the voltage at node N3 substantially to VSS.

If electromagnetic interference with waveform IW1 in FIG. 5 enters the segment driver 20 through segment output terminal 26, internal signal line 25 conducts the interference to the output stage 23 through the n-well resistor 41. This resistor 41 and the innate capacitance of the internal signal line 25 operate as a low-pass filter, that is, as a voltage attenuating element that attenuates high-frequency voltage swings. The interference waveform IW1 typically has a much higher frequency than the segment signal output by the output stage 23, so while the segment signal passes through the resistor 41 substantially unaltered, the amplitude of the interference waveform IW1 is reduced, as indicated by the attenuated interference waveform IW2.

The n-well 40 is designed to have a resistance such that for typical expected interference, the attenuated interference waveform IW2 has an amplitude less than the threshold value of the diodes 24*a*, 24*b* in the ESD protection circuit 24. Accordingly, when the attenuated interference is superimposed on the voltage output by the output stage 23 at the internal node N3, the resulting voltage swings remain within limits such that the diodes 24*a*, 24*b* stay turned off. The ESD protection circuit 24 accordingly does not alter the combined waveform of the segment signal and the attenuated interference.

The average voltage of the interference waveforms IW1 and IW2 is typically close to zero volts, so addition of the interference waveform to the segment signal output from segment output terminal 26 leaves the average voltage of the output segment signal substantially unchanged. As a result, over each scanning interval, the liquid crystal panel 10 receives the intended average voltage (V1, V2, V3, or V4) instead of a voltage that has been altered by the VDD or VSS clamping effect of the ESD protection circuit 24, and the intended image is displayed, even in the presence of electromagnetic interference.

When very strong electromagnetic interference is present and even the attenuated interference waveform has sufficient amplitude to threaten the integrity of the circuit elements in the output stage 23, the ESD protection circuit 24 operates in the conventional way, limiting voltage swings to the range between VDD and VSS to prevent damage to the segment driver 20.

Similar effects are obtained for the common driver 30.

Figure 8:
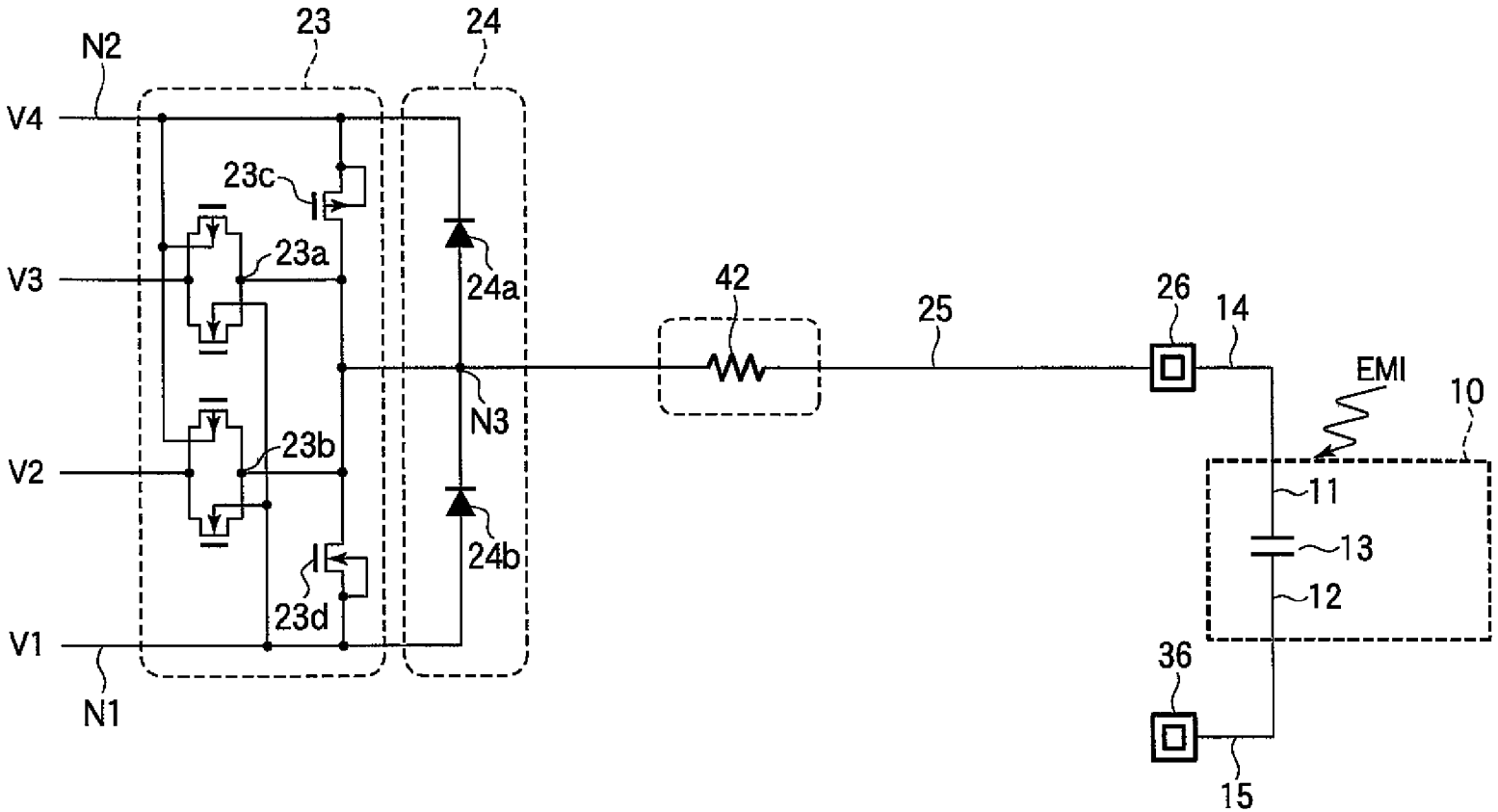
FIG. 8 is a schematic circuit diagram illustrating a variation of the first embodiment.
Figure 9:
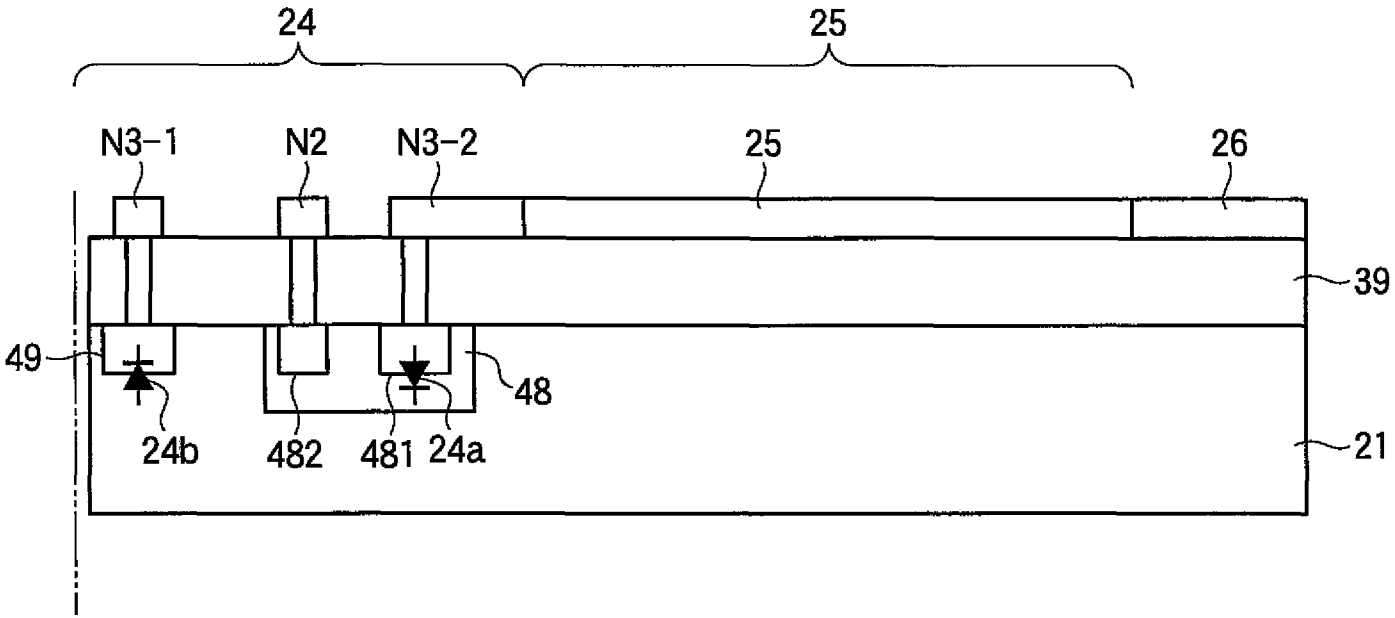
FIG. 9 is a sectional view of part of the circuit in FIG. 8.

In a variation of the first embodiment, the internal signal line 25 itself has sufficient electrical resistance to function as an attenuating element and the n-well is eliminated, as shown in FIGS. 8 and 9. Except for the replacement of the n-well resistor by a wiring resistor 42, this variation is identical to the embodiment described above.

Part or all of the internal signal line 25 interconnecting the internal node N3 and the segment output terminal 26 may be formed as a metal or polysilicon wiring pattern dimensioned to provide the desired wiring resistor 42. An exemplary resistance value of the wiring resistor 42 is about three to six kilohms (3-6 kΩ).

This variation of the first embodiment operates as described above, enabling the output of segment and common signals with average voltage levels that are not altered by VSS or VDD clamping even when moderate electromagnetic interference is present. An advantage of this variation is that it avoids a parasitic diode effect associated with the n-well resistor, as described in the next embodiment.

Second Embodiment

Figure 10:
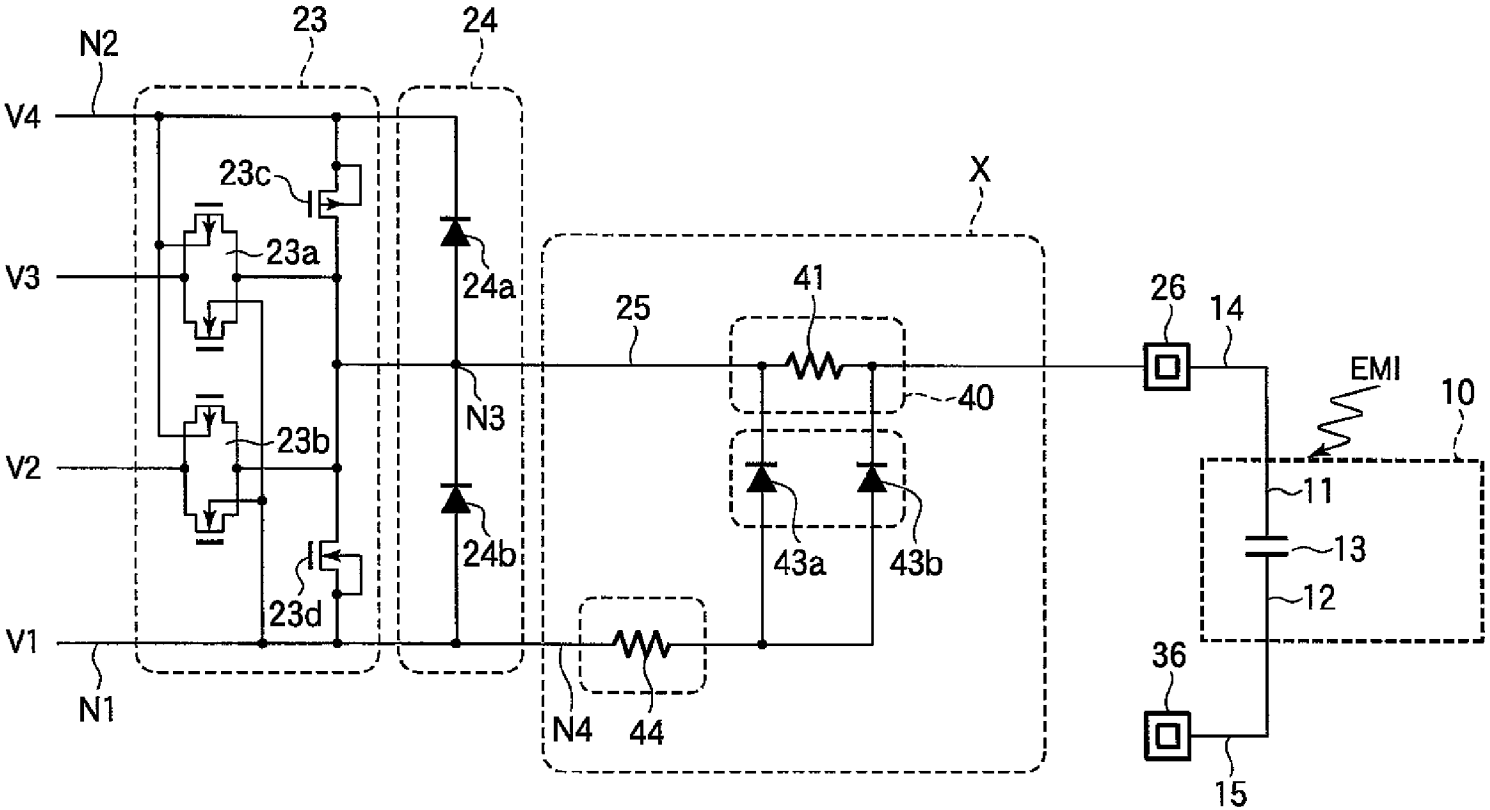
FIG. 10 is a schematic circuit diagram illustrating parts of the LCD in FIG. 4 according to a second embodiment of the invention.

Referring to FIG. 10, the second embodiment includes a third power supply node N4, diodes 43*a*, 43*b*, and a substrate resistor 44 which were present, although not shown, in the first embodiment. The third power supply node N4 is electrically connected to the first power supply node N1 and receives voltage V1, equal to the ground voltage VSS. The third power supply node N4 is also electrically connected to the internal signal line 25 through the substrate resistor 44, diodes 43*a*, 43*b*, and n-well 40. The distinguishing feature of the second embodiment lies in the resistance value of the substrate resistor 44.

Figure 11:
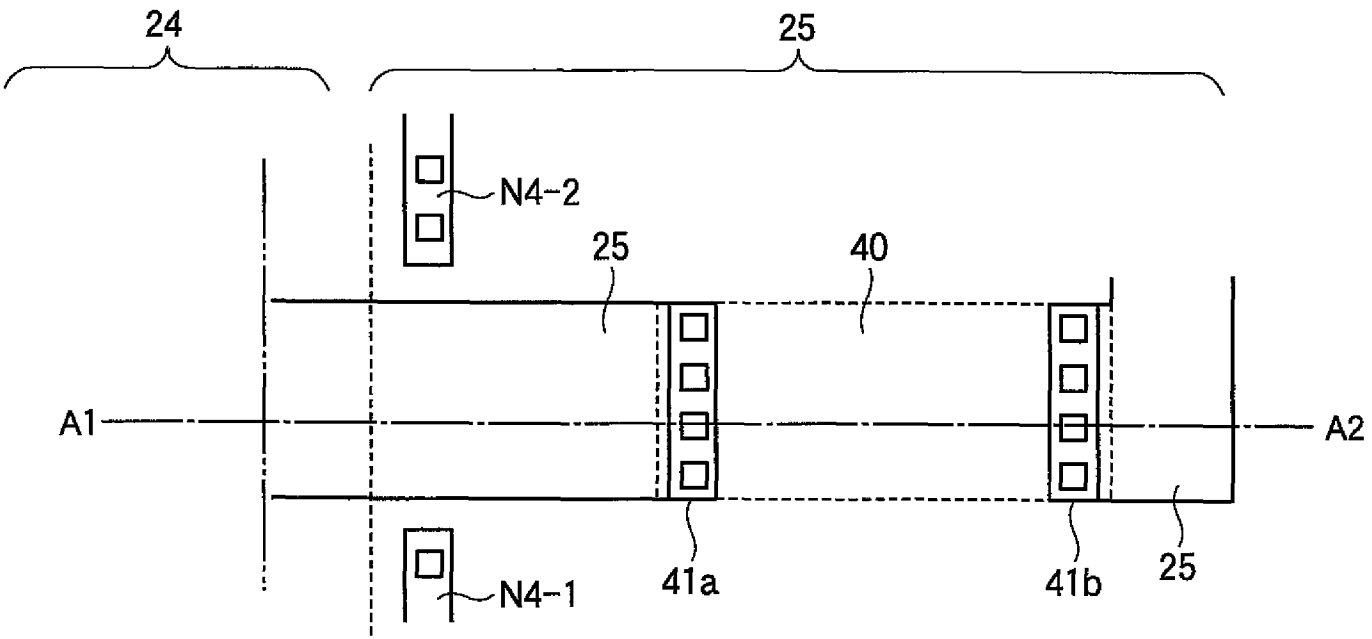
FIG. 11 is a plan view of part of the circuit in FIG. 10.
Figure 12:
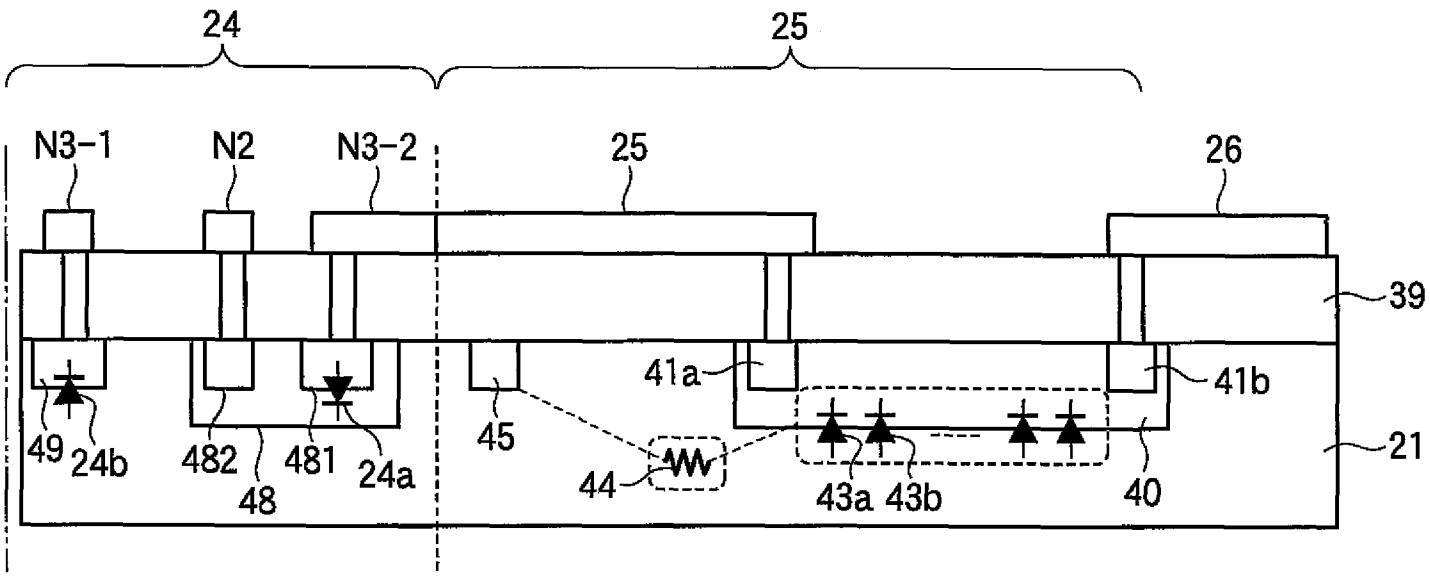
FIG. 12 is a sectional view through line A1-A2 in FIG. 11.

Referring to FIG. 11, the third power supply node comprises metal wiring N4-1, N4-2 with contact holes disposed at a predetermined distance from the n-well 40. The contact holes lead through the dielectric layer 39 to an electrode region 45, shown in FIG. 12, which is a p-type active region formed in the semiconductor substrate 21. The diodes 43*a*, 43*b* shown in FIGS. 10 and 11 represent a distributed diode formed across substantially the entire interface between the n-well 40 and the p-type substrate 21, as indicated in FIG. 12. The substrate resistor 44 is formed by the bulk resistance of the p-type semiconductor substrate 21 between the n-well 40 and the electrode region 45, and its resistance depends on the distance from the n-well 40 to the electrode region 45.

Since diodes 43*a*, 43*b* have their anodes in the semiconductor substrate 21 and their cathodes in the n-well 40, which is electrically connected to the internal node N3, they have the same VSS clamping effect as diode 24*b* in the ESD protection circuit 24. This effect, operating on the unattenuated interference waveform IW1 shown in FIG. 5, can raise the average voltage of the interference to a value greater than zero volts, affecting the average value of the output segment signal when electromagnetic interference is present.

The substrate resistor 44 between diodes 43*a*, 43*b* and the electrode region 45 in the second embodiment, however, limits this VSS clamping effect by limiting the current flow from diodes 43*a* and 43*b* to the electrode region 45 and the third power supply node N4. The effect of electromagnetic interference on the output segment signal is mitigated accordingly.

The n-well 40 in the second embodiment has the same voltage attenuating effect as in the first embodiment. In addition, the n-well 40 and electrode region 45 in the second embodiment are separated by a sufficient distance that the bulk resistance of the p-type substrate between them reduces the effect of parasitic VSS clamping by the n-well's parasitic diodes 43*a*, 43*b*, so that this parasitic VSS clamping does not significantly affect the average voltage of the output segment signals.

A similar structure is provided in the common driver 30, with a similar effect for the output common signals.

Third Embodiment

Figure 13A:
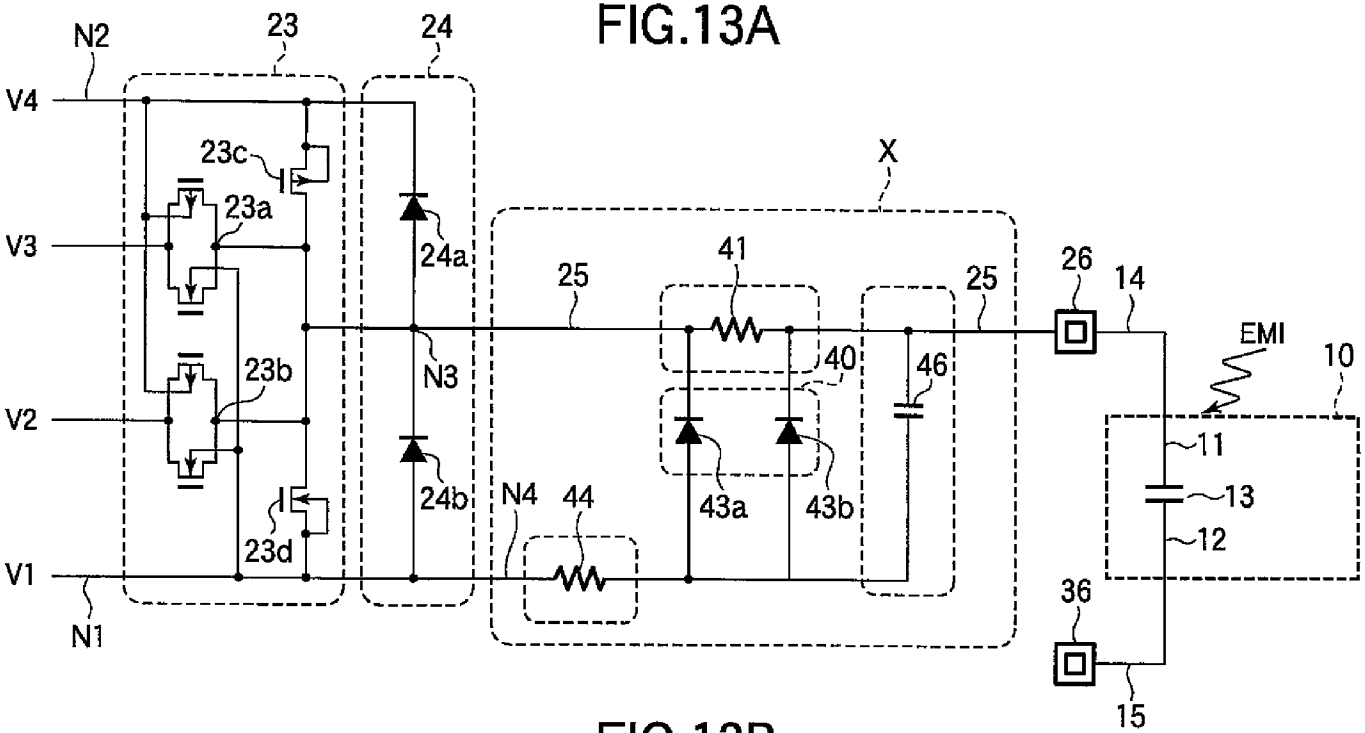
FIG. 13A is a schematic circuit diagram illustrating parts of the LCD in FIG. 4 according to a third embodiment of the invention.

Referring to the schematic view in FIG. 13A, the third embodiment adds a capacitor 46 to the structure in the second embodiment. The capacitor 46 is disposed beside the n-well 40, is electrically parallel to its parasitic diodes 43*a*, 43*b*, and is electrically connected to the segment output terminal 26.

Figure 14:
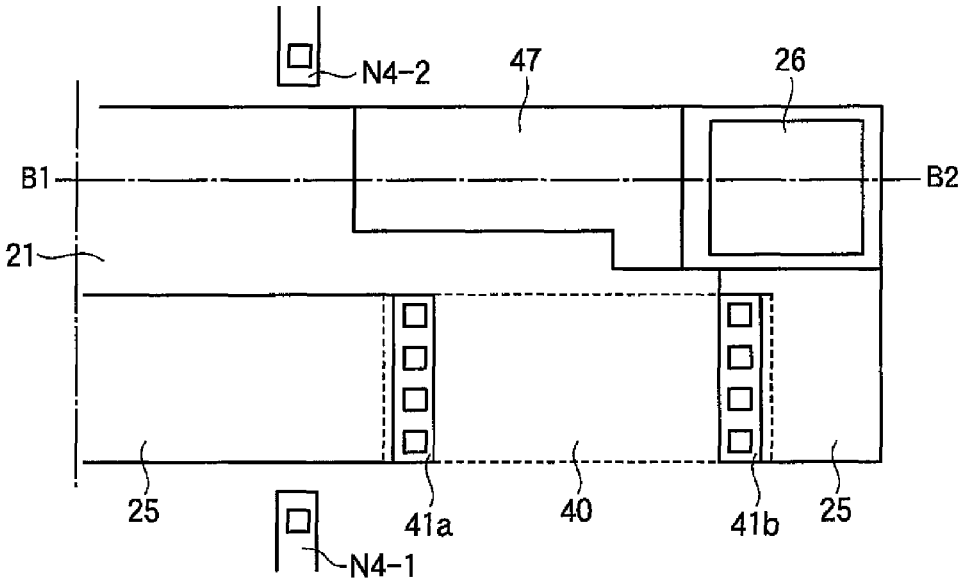
FIG. 14 is a plan view of part of the circuit in FIG. 13A.

Referring to the plan view in FIG. 14, the capacitor 46 is created by adding a capacitor electrode 47 that extends from the segment output terminal 26 over a part of the substrate 21 adjacent to one side of the n-well 40. By providing a capacitive load that electromagnetic interference intruding through the segment output terminal 26 must charge and discharge, the capacitor 46 supplements the voltage attenuating effect of the n-well.

Figure 15:
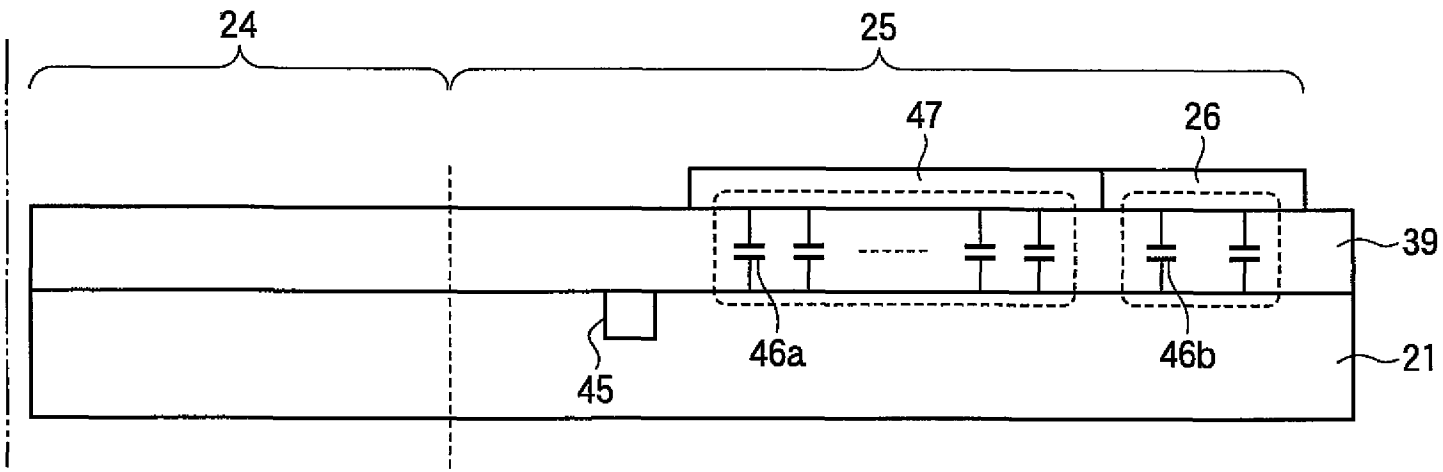
FIG. 15 is a sectional view through line B1-B2 in FIG. 14.

The capacitor 46 in FIG. 13A is a distributed capacitor including, as shown in FIG. 15, a first capacitor 46*a* formed by the capacitor electrode 47, semiconductor substrate 21, and intervening dielectric layer 39, and a second capacitor 46*b* formed by the segment output terminal 26, semiconductor substrate 21, and intervening dielectric layer 39. The second capacitor 46*b* was also present in the preceding embodiments.

In other respects, the third embodiment is similar to the preceding embodiments.

The capacitor 46 in the third embodiment extends along the entire length of the n-well 40, and is physically adjacent to the entire distributed parasitic diode represented by diodes 43*a* and 43*b*. When electromagnetic interference with a waveform such as IW1 in FIG. 5 is conducted into the n-well 40, it is also conducted into the capacitor electrode 47, and capacitive coupling due to the capacitor 46 causes a change in the voltage of the p-type semiconductor substrate 21 near the n-well 40 that mimics the voltage change in the n-well itself. If the voltage in the n-well, i.e., the cathode voltage of diodes 43*a*, 43*b*, drops below the ground voltage VSS, the voltage in adjacent the p-type semiconductor substrate 21, i.e., the anode voltage of the diodes 43*a*, 43*b*, drops simultaneously.

Figure 13B:
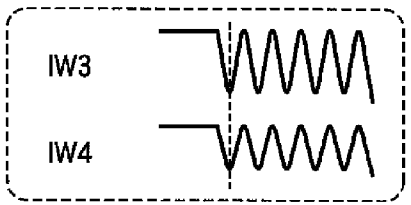
FIG. 13B is a waveform diagram illustrating voltage waveforms at two points in FIG. 13A.

Waveform IW3 in FIG. 13B represents the voltage fluctuations at an arbitrary point in the n-well 40 produced by electromagnetic interference intruding at the segment output terminal 26. This voltage waveform is similar to waveforms IW1 and IW2 in FIG. 5. Waveform IW4 in FIG. 13B represents the voltage fluctuations at an adjacent point in the substrate 21, produced by capacitive coupling between the substrate 21 and the capacitor electrode 47. Although the two waveforms differ somewhat in amplitude, they are mutually in phase.

From FIG. 13B it can be seen that when the anode and cathode potentials of diodes 43*a*, 43*b* fluctuate due to electromagnetic interference, the anode-to-cathode voltage of diodes 43*a*, 43*b* fluctuates by a lesser amount. Consequently, diodes 43*a*, 43*b* remain turned off, or if they turn on, it is for shorter intervals of time than in the second embodiment.

The capacitor electrode 47 added in the third embodiment accordingly has the effect of reducing parasitic VSS clamping by the distributed diode formed between the n-well 40 and the p-type semiconductor substrate 21. Variations in average output signal voltage due to such VSS clamping are reduced accordingly.

A further effect of the added capacitor electrode 47 and the increased capacitance of capacitor 46 is to reduce the necessary resistance of the substrate resistor 44. The size of the driver circuit can therefore be reduced.

The following exemplary variations of the first to third embodiments are also contemplated.

A p-type semiconductor substrate 21 has been used in the first to third embodiments, but an n-type semiconductor substrate may be used instead. In this case, a p-well is formed instead of n-well 40.

The drivers described in the first to third embodiments may be used to drive not only liquid crystal panels but also plasma display panels, organic light-emitting diode (electroluminescence) display panels, and various other types of display panels.

Those skilled in the art will recognize that further variations are possible within the scope of the invention, which is defined in the appended claims.

What is claimed is:

1. A semiconductor integrated circuit comprising:

a substrate on which semiconductor circuit elements are formed;

an output terminal formed on the substrate, the output terminal being connected to an external load;

an internal signal line formed on the substrate, the internal signal line connecting the output terminal to an internal node;

a voltage generator formed on the substrate, for generating a voltage and supplying the voltage to the internal node for output through the internal signal line and the output terminal to the external load;

a voltage attenuating element formed on the substrate and connected to the internal signal line, for attenuating voltage swings on the internal signal line;

a voltage limiting circuit formed on the substrate and connected to the internal node, for limiting the voltage at the internal node to a predetermined range if, after attenuation of the voltage swings by the voltage attenuating element, the voltage at the internal node exceeds the predetermined range;

a first power supply node for receiving a first power supply voltage;

a second power supply node for receiving a second power supply voltage higher than the first power supply voltage; and a third power supply node for receiving the first power supply voltage, wherein the voltage attenuating element includes a well formed in the substrate, the well being electrically connected in series with the internal signal line, the voltage limiting circuit is electrically connected to the first power supply node and the second power supply node and the predetermined range extends from the first power supply voltage to the second power supply voltage, and the third power supply node is electrically connected to the substrate at such a distance from the well that the substrate produces at a predetermined electrical resistance between the third power supply node and the well.

2. The semiconductor integrated circuit of claim 1, wherein the voltage swings are caused by electromagnetic interference external to the semiconductor integrated circuit.

3. The semiconductor integrated circuit of claim 1, wherein the substrate is a p-type semiconductor substrate and the well is an n-type well.

4. The semiconductor integrated circuit of claim 1, wherein the substrate is an n-type semiconductor substrate and the well is a p-type well.

5. The semiconductor integrated circuit of claim 1, wherein the internal signal line is connected to the output terminal through the well.

6. The semiconductor integrated circuit of claim 1, wherein the third power supply node includes:

an electrode region formed in the substrate at said distance from the well; and metal wiring for receiving the first power supply voltage, the metal wiring making electrical contact with the electrode region.

7. The semiconductor integrated circuit of claim 1, further comprising:

a first power supply node for receiving a first power supply voltage; and a second power supply node for receiving a second power supply voltage higher than the first power supply voltage; wherein the voltage limiting circuit includes a first diode having an anode connected to the first power supply node and a cathode connected to the internal node, and a second diode having a cathode connected to the second power supply node and an anode connected to the internal node.

8. The semiconductor integrated circuit of claim 1, wherein the external load is a display panel having liquid crystal cells.

9. A semiconductor integrated circuit comprising:

a substrate on which semiconductor circuit elements are formed;

an output terminal formed on the substrate, the output terminal being connected to an external load;

an internal signal line formed on the substrate, the internal signal line connecting the output terminal to an internal node;

a voltage generator formed on the substrate, for generating a voltage and supplying the voltage to the internal node for output through the internal signal line and the output terminal to the external load;

a voltage attenuating element formed on the substrate and connected to the internal signal line, for attenuating voltage swings on the internal signal line;

a voltage limiting circuit formed on the substrate and connected to the internal node, for limiting the voltage at the internal node to a predetermined range if, after attenuation of the voltage swings by the voltage attenuating element, the voltage at the internal node exceeds the predetermined range;

a dielectric layer insulating the internal signal line from the substrate; and an electrode disposed on the dielectric layer, the electrode being electrically connected to the output terminal, the electrode capacitively coupling the output terminal to the substrate through the dielectric layer to form a first capacitor that operates as part of the voltage attenuating element, wherein the voltage attenuating element includes a well formed in the substrate, the well being electrically connected in series with the internal signal line.

10. The semiconductor integrated circuit of claim 9, wherein the electrode is positioned over a part of the substrate adjacent to the well.

11. The semiconductor integrated circuit of claim 10, wherein the electrode extends parallel to the well for a full length of the well.

12. The semiconductor integrated circuit of claim 9, wherein the dielectric layer also insulates the output terminal from the substrate.

13. The semiconductor integrated circuit of claim 12, wherein the output terminal, the dielectric layer and the substrate form a second capacitor that also operates as part of the voltage attenuating element.

14. A semiconductor integrated circuit comprising:

a substrate on which semiconductor circuit elements are formed;

an output terminal formed on the substrate, the output terminal being connected to an external load;

an internal signal line formed on the substrate, the internal signal line connecting the output terminal to an internal node;

a voltage generator formed on the substrate, for generating a voltage and supplying the voltage to the internal node for output through the internal signal line and the output terminal to the external load;

a voltage attenuating element formed on the substrate and connected to the internal signal line, for attenuating voltage swings on the internal signal line;

a voltage limiting circuit formed on the substrate and connected to the internal node, for limiting the voltage at the internal node to a predetermined range if, after attenuation of the voltage swings by the voltage attenuating element, the voltage at the internal node exceeds the predetermined range; and a dielectric layer insulating the internal signal line and the resistor from the substrate, wherein the voltage attenuating element includes a resistor integral with the internal signal line.

15. The semiconductor integrated circuit of claim 14, wherein the resistor is a part of the internal signal line dimensioned to produce a predetermined electrical resistance.

* * * * *